US007565920B2

(12) United States Patent
Li et al.

(10) Patent No.: US 7,565,920 B2
(45) Date of Patent: Jul. 28, 2009

(54) WOVEN FABRIC WITH MOISTURE MANAGEMENT PROPERTIES

(75) Inventors: Yi Li, Hong Kong (CN); Jun-Yan Hu, Hong Kong (CN)

(73) Assignee: The Hong Kong Polytechnic University, Kowloon (HK)

( * ) Notice: Subject to any disclaimer, the term of this patent is extended or adjusted under 35 U.S.C. 154(b) by 243 days.

(21) Appl. No.: 11/521,616

(22) Filed: Sep. 15, 2006

(65) Prior Publication Data

US 2007/0034278 A1 Feb. 15, 2007

Related U.S. Application Data

(63) Continuation-in-part of application No. 10/703,087, filed on Nov. 7, 2003, now abandoned.

(51) Int. Cl.

| | |
|---|---|
| ***D03D 15/00*** | (2006.01) |
| ***D03D 1/00*** | (2006.01) |
| *D03D 25/00* | (2006.01) |
| *D03D 23/00* | (2006.01) |

(52) U.S. Cl. ..... 139/420 A; 139/426 R; 139/420 R

(58) Field of Classification Search ..... 139/420 A, 139/420 R, 426 R

See application file for complete search history.

(56) References Cited

U.S. PATENT DOCUMENTS

| | | | | | |
|---|---|---|---|---|---|
| 3,113,570 | A | * | 12/1963 | Holliday et al. | 604/370 |
| 3,409,012 | A | | 11/1968 | Seltzer | |
| 3,423,163 | A | * | 1/1969 | Magat et al. | 8/184 |
| 4,193,134 | A | | 3/1980 | Hanrahan et al. | |
| 4,411,660 | A | | 10/1983 | Dawn et al. | |
| 4,753,648 | A | | 6/1988 | Jackson | |
| 4,874,019 | A | * | 10/1989 | Whetstone | 139/420 A |
| 4,925,726 | A | * | 5/1990 | Whetstone | 428/196 |
| 5,185,011 | A | * | 2/1993 | Strasser | 604/385.15 |
| 5,315,717 | A | | 5/1994 | Moretz et al. | |
| 5,735,145 | A | * | 4/1998 | Pernick | 66/196 |
| 5,888,914 | A | * | 3/1999 | Katz | 442/184 |
| 6,183,847 | B1 | | 2/2001 | Goldwasser | |

(Continued)

FOREIGN PATENT DOCUMENTS

| | | |
|---|---|---|
| EP | 0 496 567 | 7/1992 |

*Primary Examiner*—Bobby H Muromoto, Jr.
(74) *Attorney, Agent, or Firm*—Leydig, Voit & Mayer, Ltd.

(57) ABSTRACT

A technique allowing manufacturers to produce woven moisture management fabrics with good moisture transfer properties is based upon a model of the fabric construction, thereby avoiding a manufacturing trial-and-error process. An initial woven fabric design including hydrophilic and hydrophobic yarns are modeled, the warp and weft yarns generally lying in a plane of the fabric. By orthographic projection onto respective planes substantially parallel to the plane of the fabric, a first view and an opposing second view of a unit cell of the model is produced. If the total projected area of hydrophobic yarn on one of the first and second views is between 40% and 70% of the total projected area, and total projected area of hydrophilic yarn on the other of the first and second views exceeds 50% of the total projected area, then a fabric according to the fabric design will have near optimum moisture wicking properties and is manufactured to the design. Otherwise, in an iterative process, one of the factors in the model is varied and the design steps repeated.

2 Claims, 10 Drawing Sheets

U.S. PATENT DOCUMENTS 6,187,391 B1 2/2001 Kataoka et al.
6,202,845 B1 3/2001 Hill
6,277,469 B1 8/2001 Wildeman
6,341,505 B1 1/2002 Dahlgren
6,427,493 B1 8/2002 Kasdan et al.
6,432,504 B1 8/2002 Yeh
6,454,814 B1 * 9/2002 Xu et al. ..... 8/116.1
6,509,285 B1 1/2003 Yeh
6,806,214 B2 * 10/2004 Li et al. ..... 442/213
7,407,514 B2 * 8/2008 Li et al. ..... 8/115.51
2002/0064639 A1 * 5/2002 Rearick et al. ..... 428/292.1
2002/0165511 A1 * 11/2002 Bast et al. ..... 604/378
2003/0082237 A1 5/2003 Cha et al.
2004/0224121 A1 * 11/2004 Sheppard, Jr. ..... 428/92
2005/0101209 A1 * 5/2005 Li et al. ..... 442/118
2005/0188470 A1 * 9/2005 Li et al. ..... 8/115.51
2006/0174420 A1 * 8/2006 Li et al. ..... 8/115.51
2006/0258247 A1 * 11/2006 Tao et al. ..... 442/301
2007/0034278 A1 * 2/2007 Li et al. ..... 139/383 A

* cited by examiner

| | Top Surface | Bottom Surface |
|---|---|---|
| Wetting time(sec) | 3.315 | 4.356 |
| Max absorption rate(%/sec) | 2.766 | 110.6284 |
| Max wetted radius(mm) | 0.0 | 30.0 |
| Spreading Speed(mm/sec) | 0.0 | 1.347 |
| One way transport capability | 361.6623 | |
| Description | MMT-700w20-6 | |

| | Top Surface | Bottom Surface |
|---|---|---|
| Wetting time(sec) | 119.953 | 3.635 |
| Max absorption rate(%/sec) | 1.0507 | 56.5156 |
| Max wetted radius(mm) | 0.0 | 30.0 |
| Spreading Speed(mm/sec) | 0.0 | 0.8554 |
| One way transport capability | 328.5712 | |
| Description | MMT-7□□021-3 | |

WOVEN FABRIC WITH MOISTURE MANAGEMENT PROPERTIES

BACKGROUND TO THE INVENTION

1. Field of the Invention

The invention relates to woven fabrics, and fabric for wicking sweat or moisture away from the skin.

2. Background Information

There is an on-going requirement to make clothing, especially sports clothing, diapers and incontinent apparel and so forth more comfortable and healthier to wear and use, even though considerable moisture or liquids may be liberated by the wearer in normal use. It is known to provide composite textile materials that comprise distinct layers of materials having respective appropriate characteristics so that moisture, or liquid, migrates or drains quickly away from an inner surface of the material in contact with the skin of a wearer. The liquid may be retained in a second outer layer in the case of a diaper or evaporate normally from an outer surface of the material where there is only one layer, in the case of sports clothing, say. Examples of known textile materials can be found in U.S. Pat. Nos. 6,509,285, 6,432,504, 6,427,493, 6,341,505, 6,277,469, 5,315,717, 5,735,145 and 4,411,660.

The typical approach to the producing woven fabrics having moisture management properties is one of trial-and-error whereby new designs are manufactured and tested until a satisfactory performance is achieved. In the area of technical textiles the manufacturer is often seeking to address a number of different design requirements in addition to moisture management characteristics, these include properties such as flexibility, durability, and thermoregulatory characteristics, many of which can be modeled by different analytical methods. It would therefore be advantageous to provide a technique allowing manufacturers to reliably produce new woven fabrics with satisfactory moisture management properties.

SUMMARY OF THE INVENTION

In one aspect the invention provides a technique for producing a woven moisture management fabric having quantities of hydrophilic and hydrophobic yarns, comprising:

a. selecting an initial fabric design comprising a yarn crossing scheme, yarn cross section for each yarn, and yarn spacing in the warp and weft directions;
b. creating a model of the yarns of the fabric design;
c. identifying a plane of the fabric in which warp and weft yarns generally lie;
d. identifying a repeating unit cell of the model or a discrete multiple of unit cells;
e. identifying, from orthographic projection onto respective planes substantially parallel to the plane of the fabric, a first side view and an opposing second side view of the unit cell or the discrete multiple of unit cells;
f. calculating and summing the projected areas of each yarn in one of the first and second side views to determine a total projected area;
g. calculating and summing the projected areas of each hydrophilic yarn in the first and second side views respectively to determine a total projected area of hydrophilic yarn;
h. calculating and summing the projected areas of each hydrophobic yarn in the first and second side views respectively to determine a total projected area of hydrophobic yarn;
i. if the total projected area of hydrophobic yarn on one of the first and second side views is between 40% and 70% of the total projected area, and total projected area of hydrophilic yarn on the other of the first and second side views exceeds 50% of the total projected area, then manufacturing a fabric according to the fabric design,
j. or otherwise varying at least one of: the quantities of hydrophilic and hydrophobic yarns, yarn crossing scheme, yarn cross section for each yarn and yarn spacing; and repeating steps b to i.

In another aspect there is provided a technique for producing a woven moisture management fabric having a design including quantities of hydrophilic and hydrophobic yarns, comprising:

a. selecting an initial fabric design comprising a yarn crossing scheme, yarn cross section for each yarn, and yarn spacing in the warp and weft directions;
b. summing the areas or structure cross points of each hydrophilic yarn on first and second sides of the fabric to determine a hydrophilic area;
c. summing the areas or structure cross points of each hydrophobic yarn on first and second sides of the fabric to determine a hydrophobic area;
d. if the hydrophobic area on one of the first and second sides is between 40% and 70% of a total area, and the hydrophilic area on the other of the first and second sides exceeds 50% of the total area, then manufacturing a fabric according to the fabric design,
e. or otherwise varying at least one of: the quantities of hydrophilic and hydrophobic yarns, yarn crossing scheme, yarn cross section for each yarn and yarn spacing; and repeating steps b to d.

In a still further aspect the invention provides a technique for producing a woven moisture management fabric having quantities of hydrophilic and hydrophobic yarns, comprising:

a. summing the areas or structure cross points of each hydrophilic yarn on first and second sides of the fabric to determine a hydrophilic area;
b. summing the areas or structure cross points of each hydrophobic yarn on first and second sides of the fabric to determine a hydrophobic area;
c. if the hydrophobic area on one of the first and second sides is between 40% and 70% of a total area, and the hydrophilic area on the other of the first and second sides exceeds 50% of the total area, then manufacturing a fabric according to the fabric design.

According to the invention there is provided a woven fabric comprising a generally uniform woven structure consisting of hydrophobic and hydrophilic materials, the woven structure having an inner exposed surface of hydrophobic and hydrophilic materials that is between 40% and 70% the hydrophobic material, and having an outer exposed surface of hydrophobic and hydrophilic materials that is predominantly the hydrophilic material.

Preferably, the hydrophobic material is polypropylene.

Preferably, the hydrophobic material is polyester.

Preferably, the hydrophobic material is natural fiber selected from cotton, wool, silk and linen, and which are treated with a water repellent agent.

Preferably, the water repellent agent is HYDROPHOBL CF.

Preferably, the water repellent agent is $SiO_x$ nano water repellence agent.

Preferably, the hydrophilic material is absorbent yarn made from synthetic fiber.

Preferably, the synthetic fiber is coolmax or coolplus.

Preferably, the hydrophilic material is absorbent yarn made from natural fiber.

Preferably, the natural fiber is one of cotton, silk, wool or linen.

Preferably, the natural fiber is treated with a hydrophilic finishing agent with nano particles such as $TiO_2$ and ZnO for creating nanostructures.

Preferably, the woven fabric structure is one of plain weave, twill weave or sateen weave.

The fabric can be used in components of clothing including sports wear, casual wear, uniform and pants. It can also be used in components of a diaper, or household articles such as bed sheet, covers and pillows.

Further aspects of the invention will become apparent from the following description, which is given by way of example only.

BRIEF DESCRIPTION OF THE DRAWINGS

Embodiments of the invention will now be described with reference to the accompanying drawings in which.

DESCRIPTION OF THE PREFERRED EMBODIMENTS

According to a preferred embodiment of the invention a flat woven fabric with moisture management properties for use in garments includes inner and outer surfaces. The inner surface is, in use, worn next to the skin of a wearer, and has a high proportion of hydrophobic areas or structure points and a low proportion of hydrophilic areas or structure points. In the preferred embodiment the hydrophobic areas occupy 40%-70% of the inner surface. The outer surface, positioned away from the wearers skin, has a high proportion of hydrophilic areas or structure points. The hydrophilic fibers/yarns transfer any liquid or moisture from the inner side of the fabric to the outer side.

The low proportion of hydrophilic points/areas on the inner surface allows quick absorption of liquid water and enable wicking actions, while the high proportion of hydrophobic points/areas on the inner surface is able to keep the surface relatively dry and prevent the liquid water wicking back to the inner surface.

The terms hydrophobic and hydrophilic are comparative terms and depend upon selection of fibers and yarn with different surface tension, contact angle, shape of cross section, diameters of fibers, chemical and physical finishing, and so forth. Thus it will be understood that the terms "hydrophobic" and "hydrophilic" are used in the specification and claims as relative terms. This means that the Woven fabric is made up of materials that are hydrophobic and hydrophilic relative to one another rather than necessarily having such properties in comparison to a norm or some industrial standard, for example.

A wide range of hydrophobic yarns can be selected for the fabric. Such yarns can be synthetic yarns, like polypropylenes, etc., or natural fibers finished with the use of chemicals or nano technology to enhance their hydrophobic properties. Examples include cotton yarns finished by water repellent agent, Ciba's HYDROPHOBL CF, or Zhousan Mingri nanotechnology company's water repellent agent. In the preferred embodiment polypropylene is chosen for the hydrophobic yarn.

Likewise, hydrophilic yarns can be selected from a wide range of synthetic yarns or fibers. Examples include coolmax, coolplus, natural yarns/fibers such as cotton, or yarns finished with the use of chemicals or nano technology to modify their hydrophilic properties by hydrophility finishing agent such as FZ agent. In the preferred embodiment coolmax is chosen for the hydrophilic yarn.

The moisture management properties of the fabric depend on the proportion of the hydrophobic areas or points on the inner surface. For polypropylene hydrophobic yarn used with pure cotton hydrophilic yarn the range of polypropylenes structure points on the inner surface should be 40% to 70% for optimum moisture management.

Figure 1:
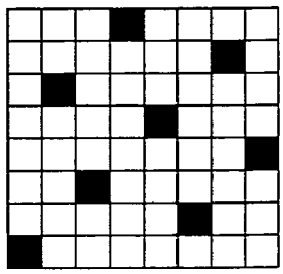
FIG. 1 illustrates the structure of denim cotton yarn of a woven fabric according to the invention.
Figure 2:
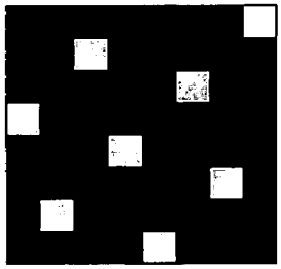
FIG. 2 illustrates the structure of polypropylene of a woven fabric according to the invention.

A series of woven fabrics with different percentage of hydrophobic points/areas were developed and measured. As an example, the structure of a fabric, WMMF006, is designed as shown as in FIGS. 1 and 2. The warp yarn is 100D polyester. The structure of the fabric in FIG. 1 is 20S denim cotton yarn, and the structure of the fabric in FIG. 2 is 83.3dex polypropylene. The pattern arrangement is polypropylene: cotton: polypropylene =1:1:1. The content of fabric is cotton 45%,polypropylene 25%, polyester 30% and the structure is 100D×(20*s*+83.3 dtex)/55.1 ends/cm×90 ends/cm.

Figure 3:
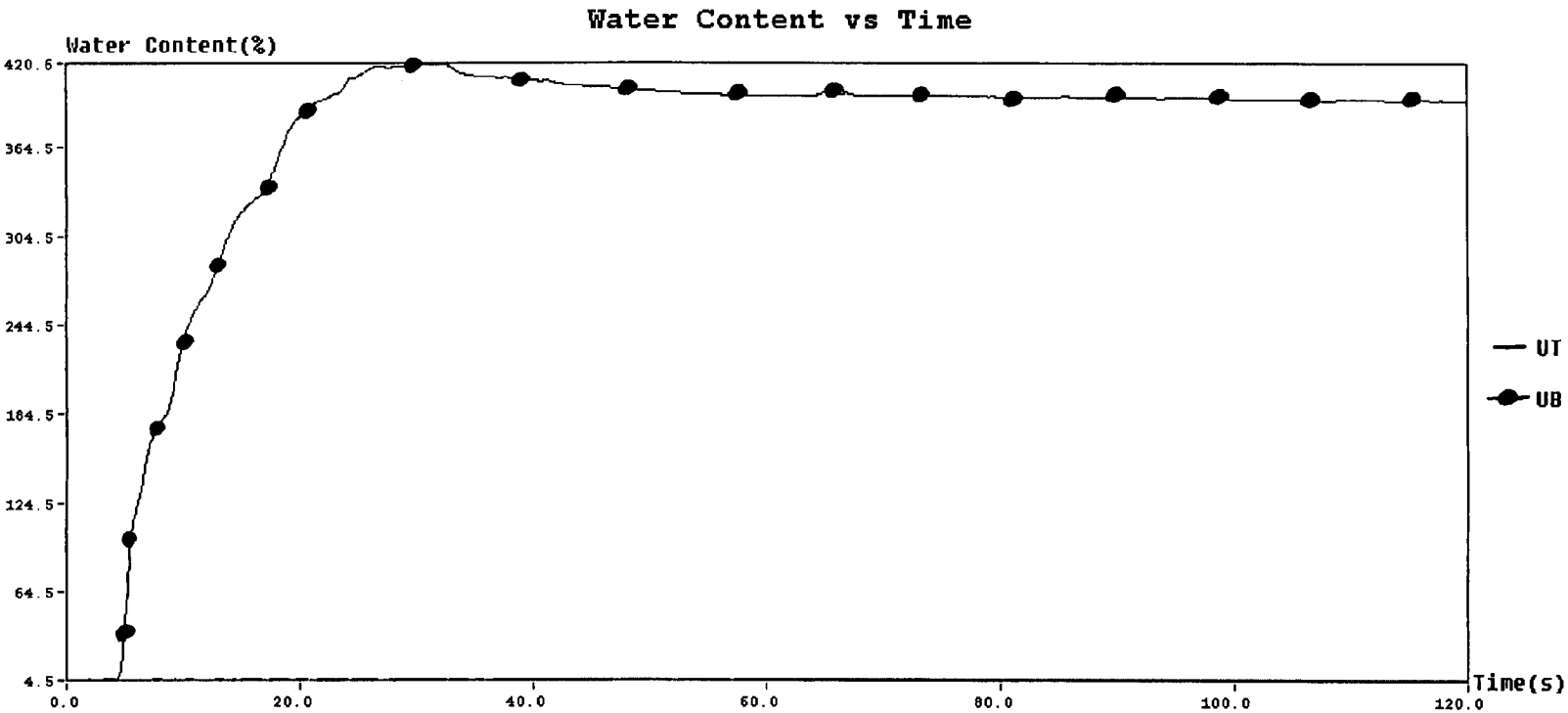
FIG. 3 is a typical measuring curve of the woven fabric.

The moisture management properties of the fabric were tested using a moisture management tester to determine moisture management indexes. The fabric is sandwiched between two plates. Electrical conductors arranged in concentric opposing pairs are used to measure changes in electrical resistance of the fabric. A quantity of water (or other chosen liquid) is poured down a guide pipe and changes of resistance measured against time. From this data, specific indexes are determined, in a repeatable fashion, and used for determining moisture management characteristics of the fabric. Details of the tester can be found inventors U.S. Pat. No. 6,499,338. The typical measuring curve of the woven fabric is shown in FIG. 3.

Figure 4:
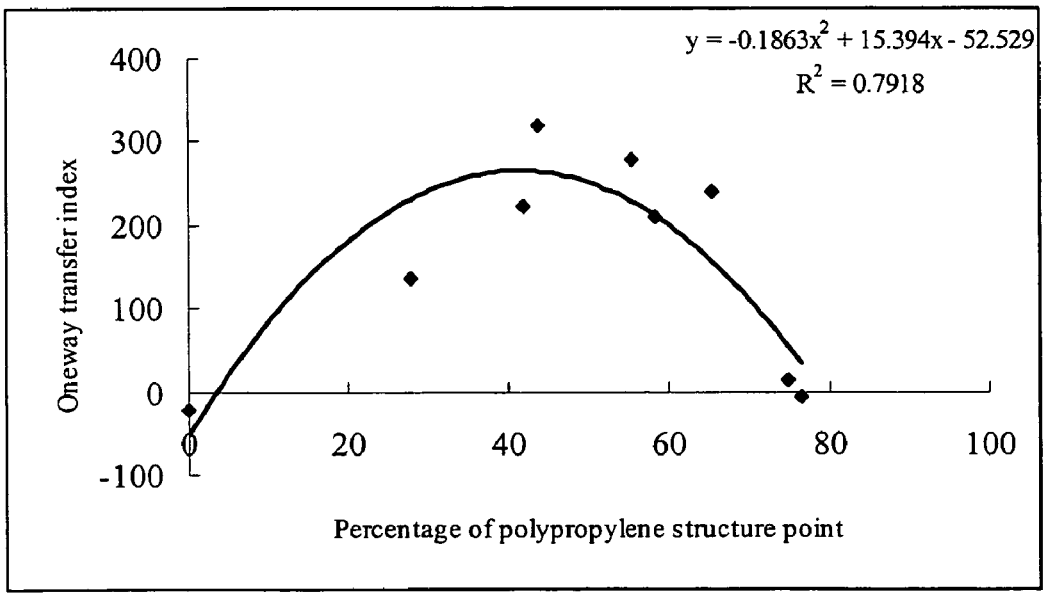
FIGS. 4 to 11 illustrate how difference percentage points/areas on the inner surface of polypropylenes or coolmax influence the measurement results of one-way transfer of the fabric and over all moisture management properties.

FIG. 4 shows the influence of percentage of inner surface structure points of polypropylenes on the fabric one way transfer property.

Figure 5:
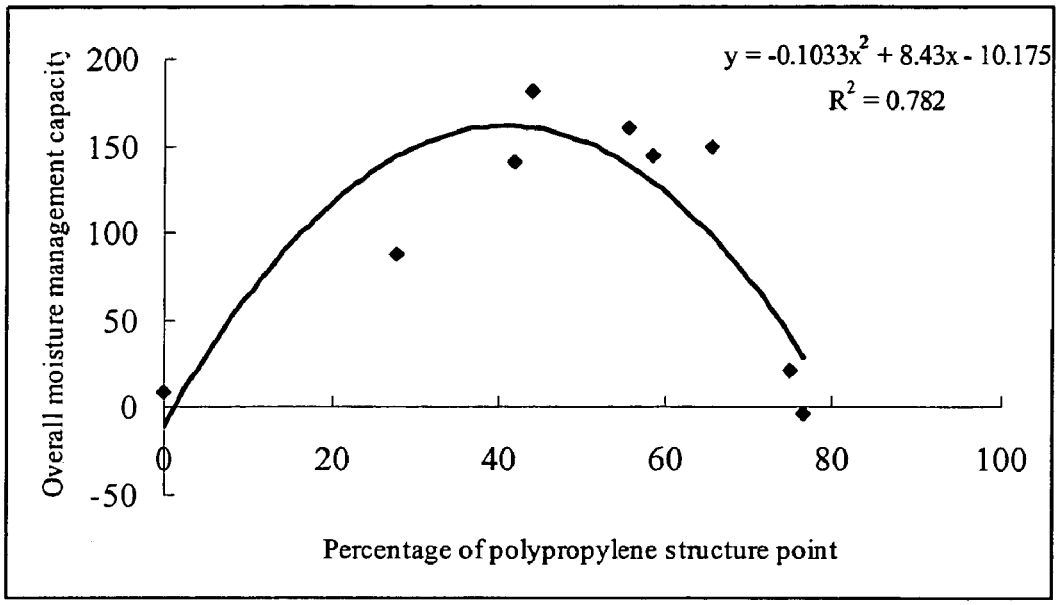

FIG. 5 shows the influence of percentage of inner surface structure point of polypropylenes on the fabric overall moisture management capacity.

Figure 6:
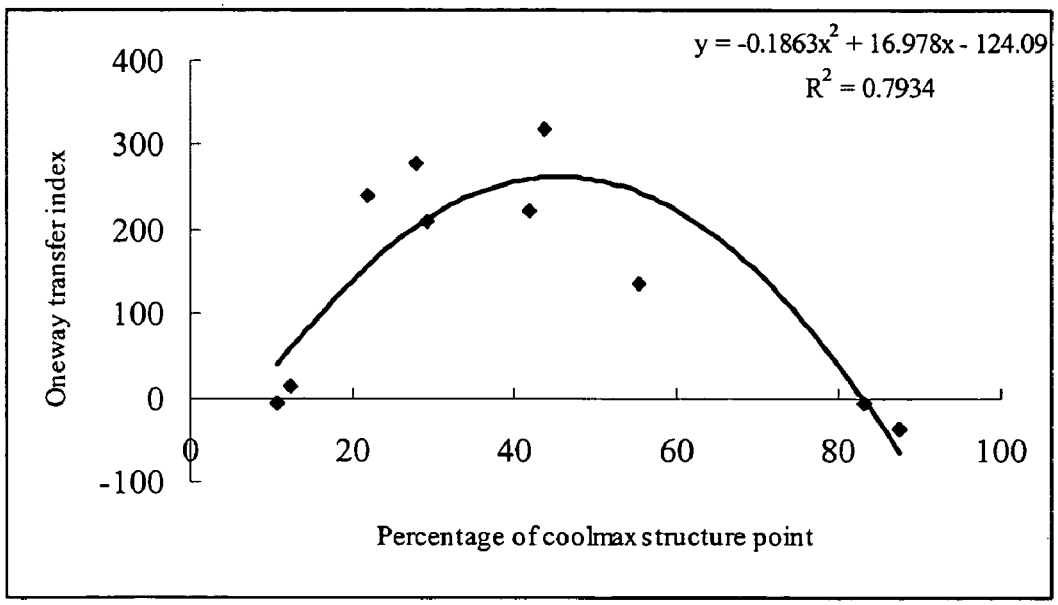

FIG. 6 shows the influence of percentage of inner surface structure point of coolmax on the fabric one way transfer property.

Figure 7:
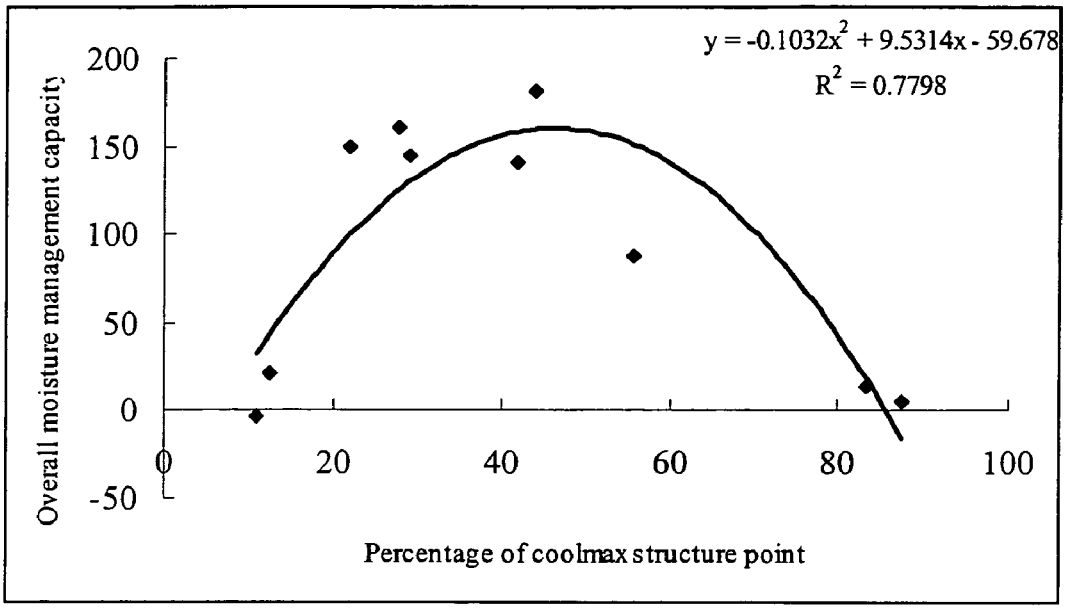

FIG. 7 shows the influence of percentage of inner surface structure point of coolmax on the fabric overall moisture management capacity.

Figure 8:
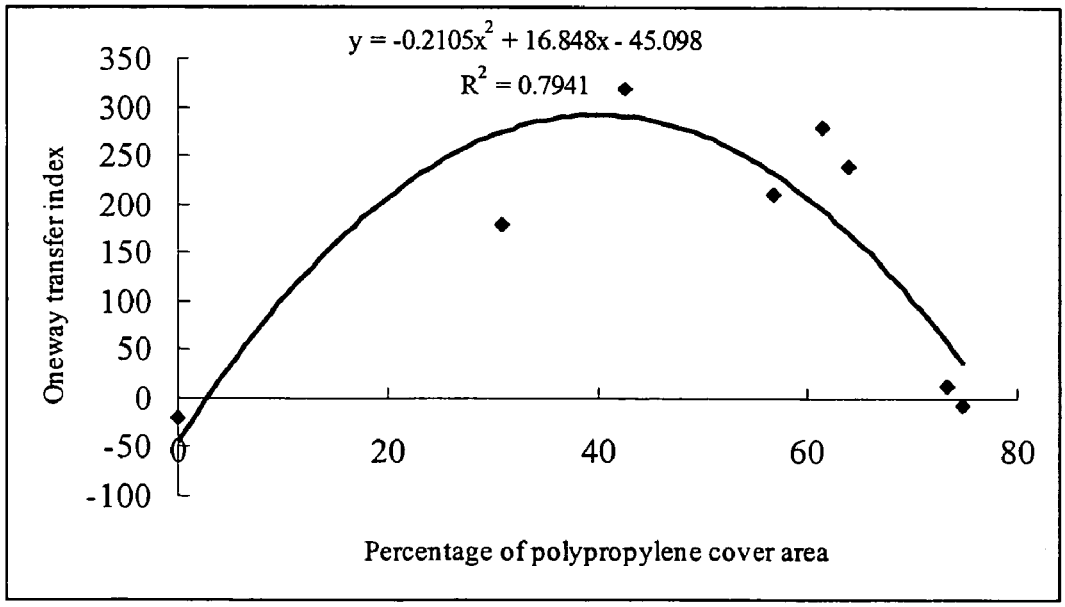

FIG. 8 shows the influence of percentage of inner surface area of polypropylene on the fabric one-way transfer property.

Figure 9:
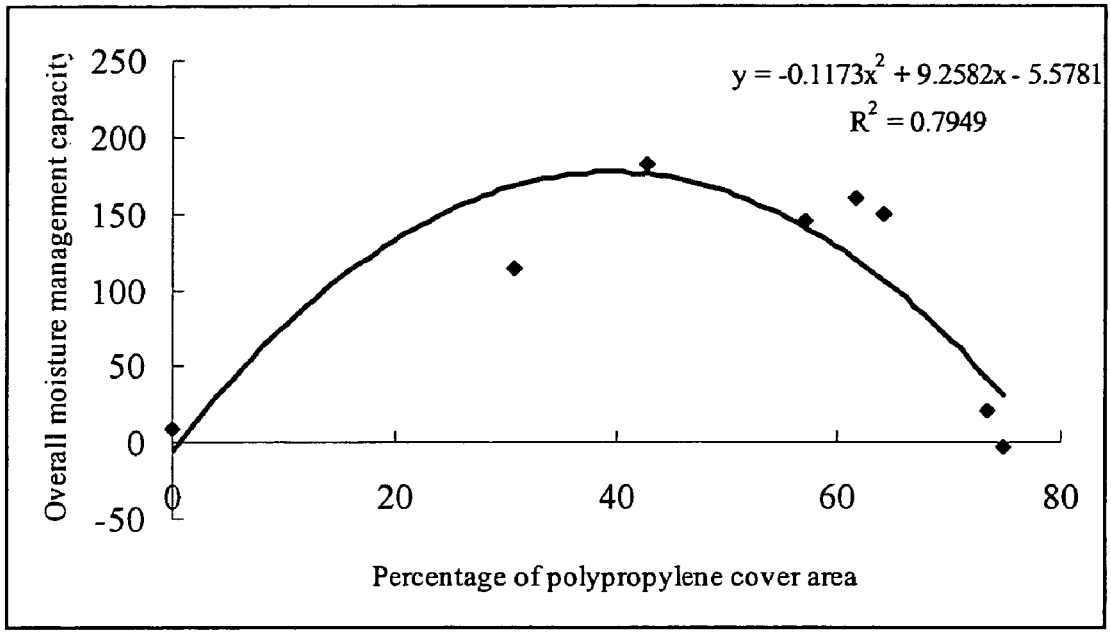

FIG. 9 shows the influence of percentage of inner surface area of polypropylene on the fabric overall moisture management capacity.

Figure 10:
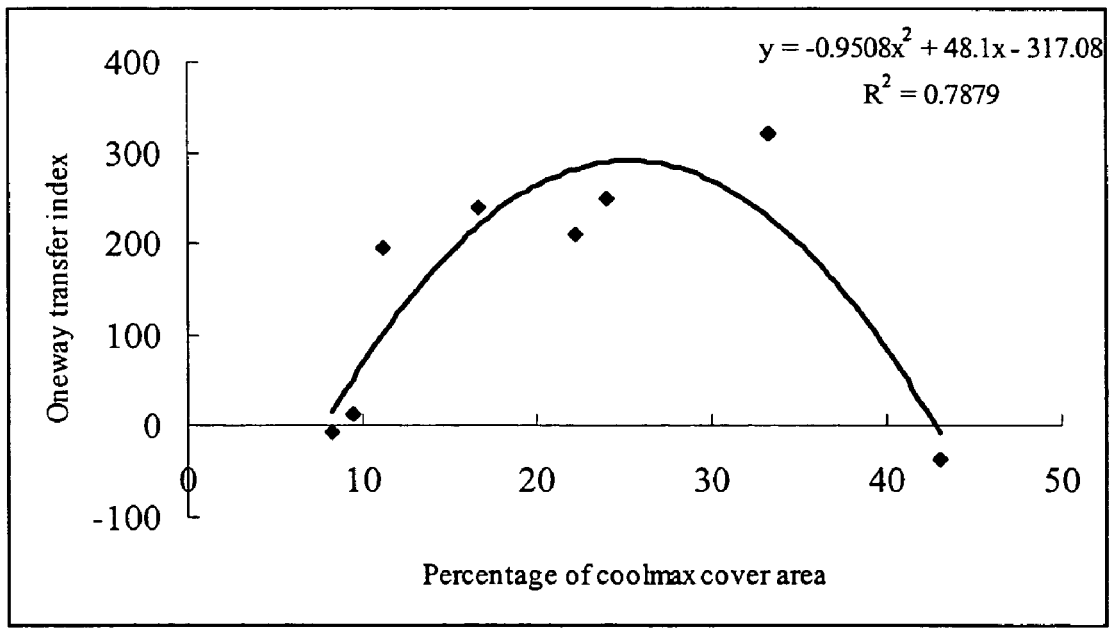

FIG. 10 shows the influence of percentage of inner surface area of coolmax on the fabric one-way transfer property.

Figure 11:
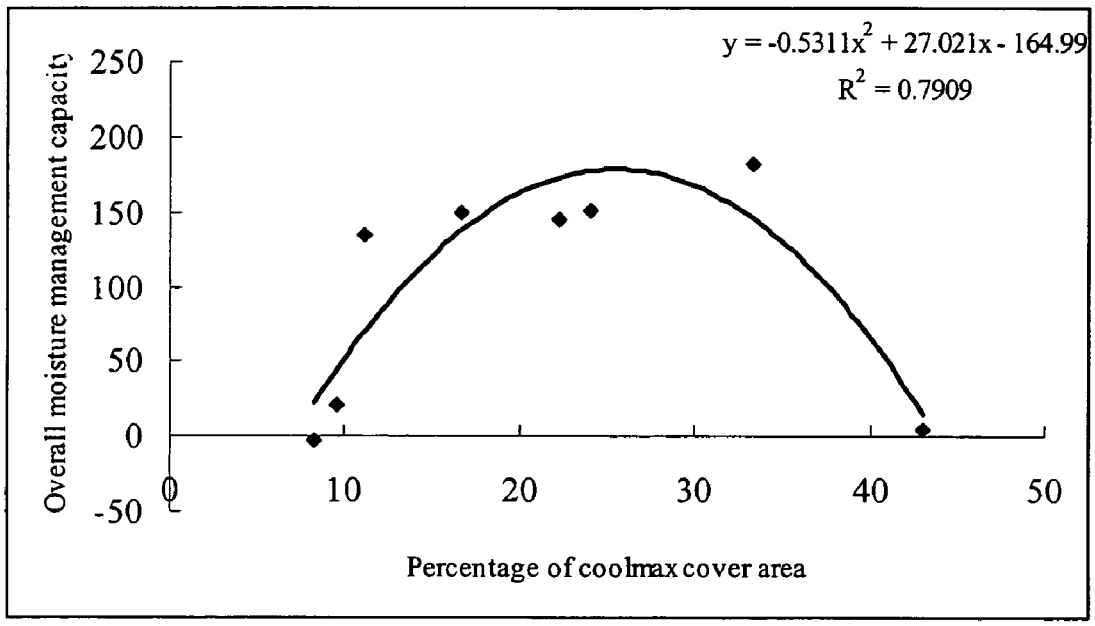

FIG. 11 shows the influence of percentage of inner surface area of coolmax on the fabric overall moisture management capacity.

Figure 12:
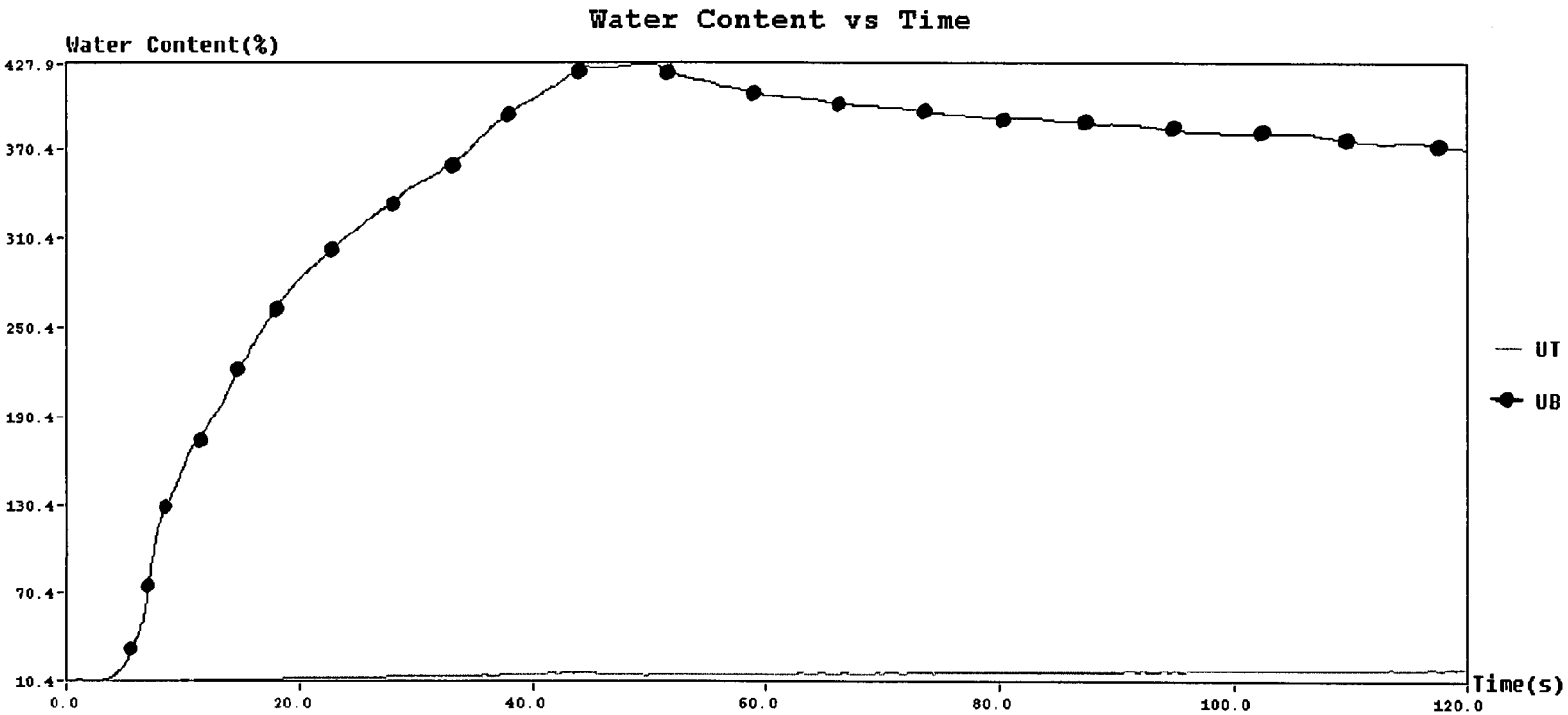
FIG. 12 is the typical measurement curve of the fabric in which the hydrophobic yarn is pure cotton pre-treated by nano water repellent agent.

In an alternative embodiment of the invention polypropylenes or coolmax is replaced by is pure cotton yarns pretreated by a nano water repellent agent as hydrophobic yarn. The typical measurement curve for this alternative embodiment is shown in FIG. 12.

The fabric according to the invention can more easily transport the liquid water from the inner surface to the outer surface than the normal fabrics, such as pure cotton fabric, and so maintain the comfort feeling during the wearing, especially under the heavy sweating rate.

Where in the foregoing description reference has been made to integers or elements having known equivalents then such are included as if individually set forth herein.

Figure 13A:
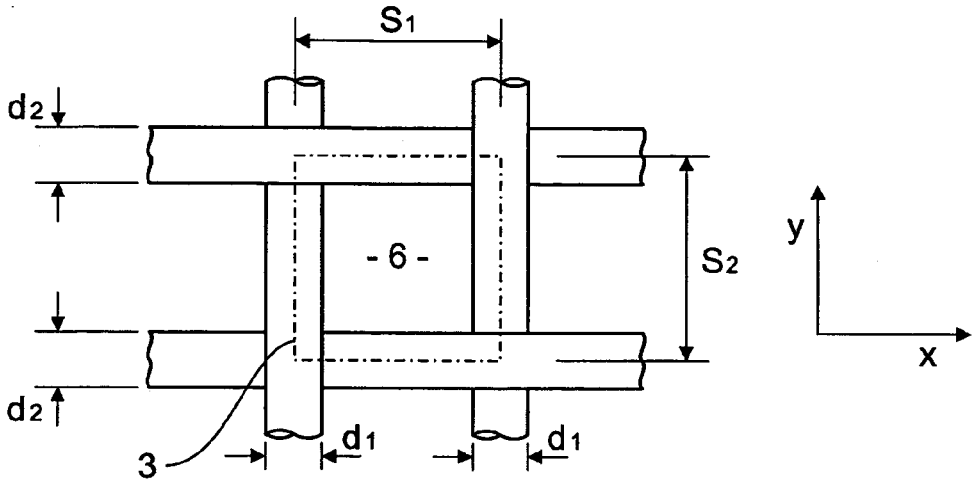
FIG. 13*a* is a plan view of a portion of a plain weave fabric.
Figure 13B:
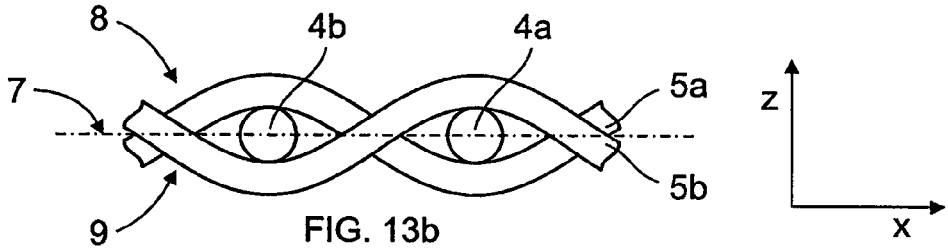
FIG. 13*b* is a side elevation of the fabric portion of FIG. 13*a;*
Figure 13C:
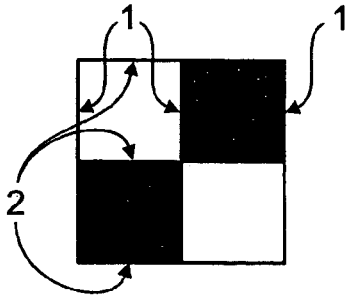
FIG. 13*c* is a schematic of the fabric portion of FIG. 13*a;*

Referring to the drawings, woven fabric is composed of two sets of interlacing, mutually orthogonal (warp and weft) yarns. FIGS. 13*a* and 13*b* show a plain weave in which one warp yarn and one weft yarn cross at a time, the warp yarns running vertically and the weft yarns running horizontally. Additionally, the plain weave is illustrated in the yarn crossing scheme schematic FIG. 13*c*. The space between two adjacent vertical lines 1 illustrates a warp yarn, and the space between every two adjacent horizontal lines 2 illustrates a weft yarn. To mark the crossing points, the relevant square is marked by solid black, that is the crossing of the warp and weft yarns, at all places where the warp yarns overlie the weft yarns. Accordingly, the white squares indicate weft yarns lying on top.

FIGS. 13*a* and 13*b* illustrate a model of yarns of a fabric design having moisture management properties and defined by:

- the crossing scheme
- yarn cross section for each yarn (diameters d1 for the warp yarns and d2 for the weft yarns)
- yarn spacing ($S_1$ and $S_1$ are the linear spacings of the yarns in the warp and weft directions respectively)
- the hydrophilic and hydrophobic properties of each yarn The method of the invention exploits the periodicity of the repeating pattern of the crossing scheme in a woven fabric to isolate a repeating moisture management unit cell. Assuming the warp yarns 4*a*, 4*b* are hydrophilic and the weft yarns 5*a*, 5*b* are hydrophobic then the moisture management unit cell 3 is bordered in FIG. 13*a* by the dashed rectangle 3 and shown separately in FIGS. 13*d* and 13*e*. A moisture management unit cell (abbreviated to "unit cell" herein) refers to the smallest repeating volume of a material which fully characterises the structure. The unit cell 3 has a rectangular border of dimension $S_1 \times S_2$, more specifically the unit cell 3 is bounded by the longitudinal centre lines of the warp yarns 4*a*, 4*b* and the weft yarns 5*a*, 5*b* around a central opening 6. Overall properties for the fabric are calculated by making certain assumptions about the internal geometry of the unit cell 3.

While this example shows the unit cell 3 being the same as the smallest repeating geometric unit of the fabric which defines the geometry, this will not always be the case since the model also depends on the hydrophilic and hydrophobic properties of the yarn. For example, if only every tenth warp yarn was hydrophilic the unit cell would be correspondingly enlarged to fully characterise the structure.

It is assumed each yarn has a constant cross-section throughout its length. Each yarn is a bundle of filaments and the yarn cross-sectional area is determined by the number of filaments as well as yarn and fabric manufacturing parameters. However for any given fabric construction knowing the linear density of the yarn (its weight per unit length) as used in the manufacture of the fabric, and the density of the yarn (its weight per unit volume) or its specific density (ratio of the volume of yarn to that of the same weight of water) allows determination of the unknown yarn cross-sectional area which is required to model each yarn within the unit cell 10.

For the purposes of the invention it has been found that yarns should be assumed to have a circular cross-section. Thus, knowing the cross-sectional area, the diameter can be determined for this feature of the model. This assumption however is not essential to the method, and where the shape assumed by the yarns in the fabric is known, this shape can be approximated in the model.

In the examples illustrated it is also assumed in the crossing schemes shown that the weft yarns 5*a*, 5*b* undulate, their centrelines lying in parallel planes. It is assumed there is no undulation in the warp yarns 4*a*, 4*b*, which are parallel and coplanar. Using a Cartesian system of coordinates (x, y, z), for example, if the warp yarns are elongated parallel to the y-axis and spaced apart from the weft yarns at each crossing point in the z-direction, the undulating centreline of each weft yarn lies in a plane parallel to the xz-plane.

The fabric may be modelled as a planar sheet with the warp and weft yarns generally lying in a plane of the fabric 7 (see FIG. 13*b*). Under the assumption that there is no undulation in the warp yarns the common plane of the longitudinal centrelines of all warp yarns 4*a*, 4*b* (or the xy-plane in the Cartesian system) defines this plane of the fabric 7. This assumption however is also not essential to the method. If the model assumes that the centrelines of both warp and weft undulate then the plane of the fabric 7 remains the xy-plane for undulations in the mutually perpendicular xz- and yz-planes respectively.

Figure 13D:
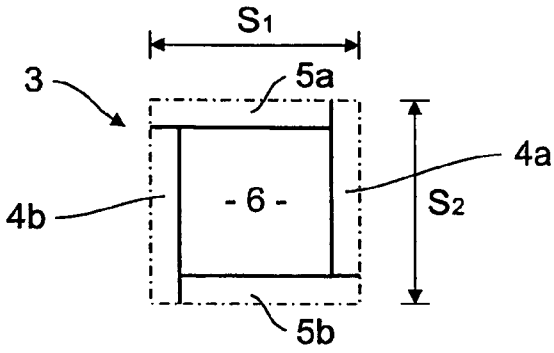
FIGS. 13*d* and 13*e* are first and second opposing side views of a unit cell of the fabric of FIG. 13*a;*
Figure 13E:
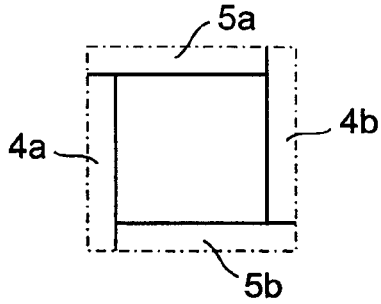

Considering the model thus created the unit cell 3 has first and second opposing sides 8, 9. FIG. 13*d* shows the first side view of the unit cell 3, which is made by the engineering drawing technique of orthographic projection, for example from the view shown in FIG. 13*b*, projected onto a plane parallel to the plane of the fabric 7. FIG. 13*e* shows the opposing view of the second side 9. From FIGS. 13*d* and 13*e* the total projected area ($A_{tot}$) of the yarns 4*a*, 4*b*, 5*a*, 5*b* on each of the sides is calculated from the following formula:

$$A_{tot}=d_2 S_1+d_1 S_2$$

The method requires identifying yarns which are hydrophilic and hydrophobic, then calculating and summing the projected areas of each hydrophilic and each hydrophobic yarn in the first and second side views to determine a total projected area of each hydrophilic and each hydrophobic yarn.

As the warp yarns 4*a*, 4*b* are hydrophilic and the weft yarns 5*a*, 5*b* are hydrophobic, total projected area of hydrophilic yarn on the first side ($A_{1phi}$) is calculated from the following formula:

$$A_{1phi}=d_2 S_1$$

The total projected area of hydrophobic yarn on the second side ($A_{2pho}$) is calculated from:

$$A_{2pho}=d_1S_2$$

Figure 15:
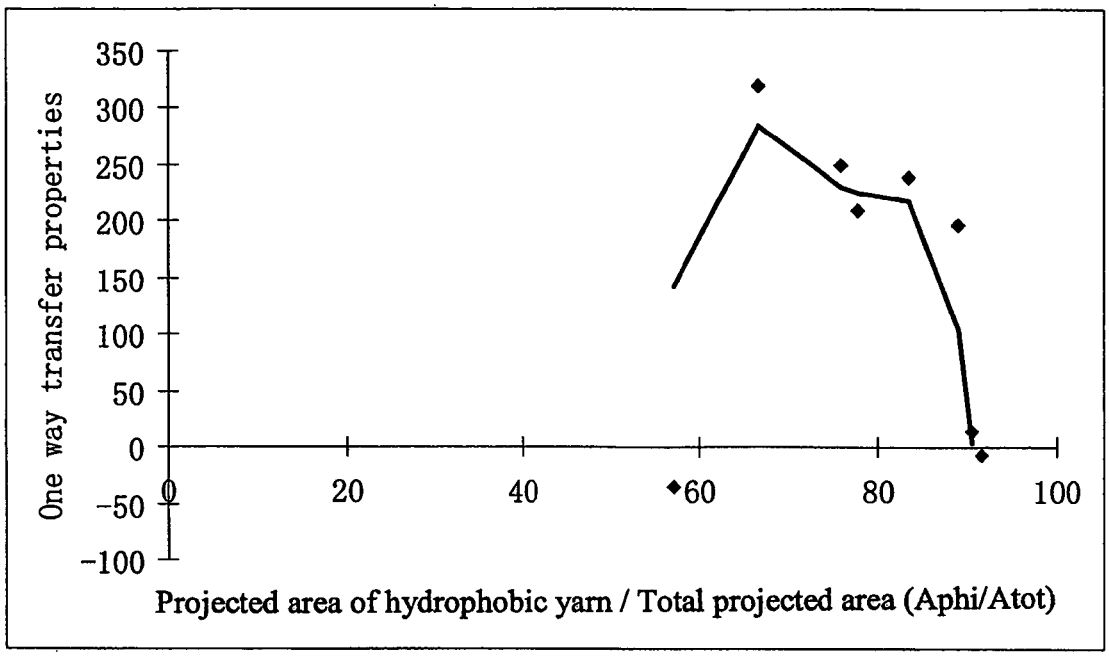
FIG. 15 is a graph illustrating the variation of area ratios calculated by the method of the invention with a one-way transfer index measuring the wicking ability of the fabric.

As seen in FIG. 15, experimental work on various fabric constructions has revealed a relationship to exist between $A_{1phi}$ and $A_{2pho}$ as a percentage of $A_{tot}$ which provides a fabric with good moisture wicking performance as measured by the one-way transfer index (using apparatus as described in the inventor's U.S. Pat. No. 6,499,338).

If $A_{2pho}$ is between 40% and 70% of $A_{tot}$, and $A_{1phi}$ exceeds 50% of $A_{tot}$, then a fabric according to the fabric design represented by the model is manufactured. Fabric manufacturing processes for achieving a given fabric design are well-known and are therefore not described. It will be apparent that the method of the invention could be readily implemented by computer, in particular the model may be created using computer-aided fabric design software. In this way a number of variations of the model can be readily determined, before one falling within the above ranges is selected.

Figure 14A:
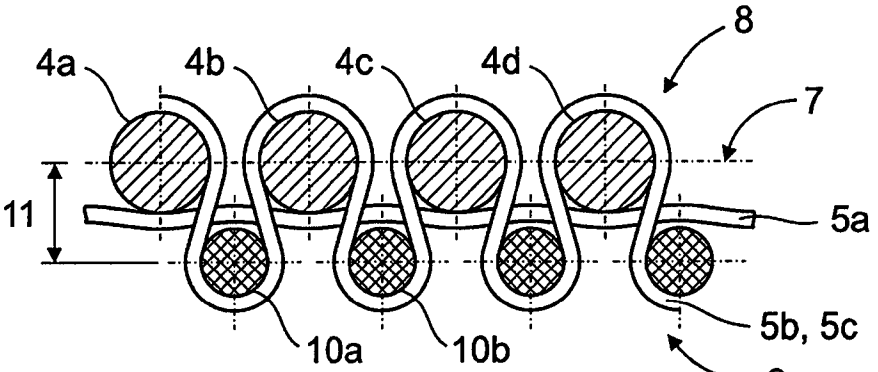
FIG. 14*a* is a side elevation of a portion of a second woven fabric.
Figure 14B:
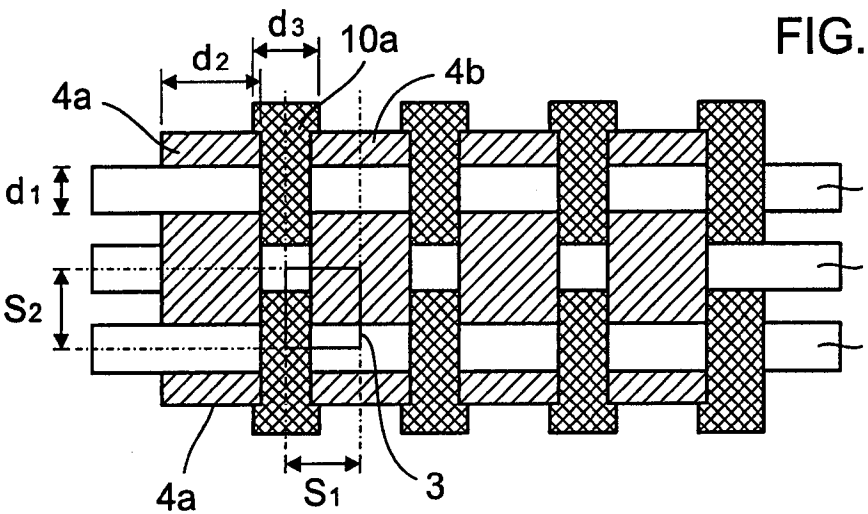
FIGS. 14*b* and 14*c* are first and second opposing side views of the fabric of FIG. 14*a;*
Figure 14C:
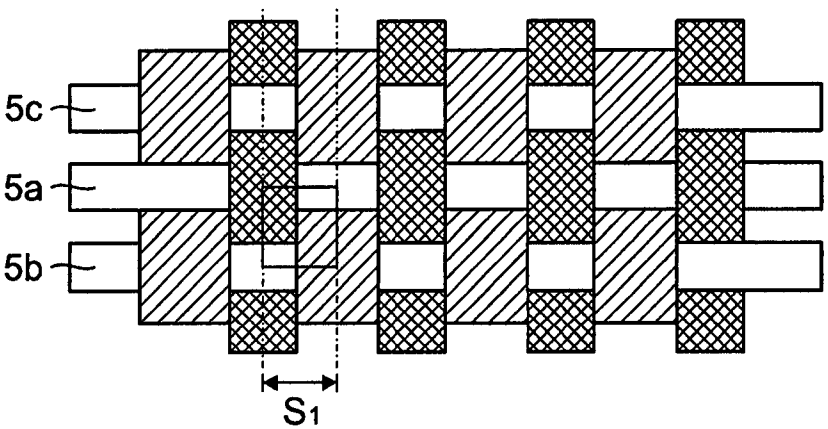

In FIG. 14*a*-14*c*, there is analogously illustrated a weave formed by large diameter warp yarns 4*a*, 4*b* etc alternating with warp yarns 10*a*, 10*b* etc of smaller diameter, by way of a further example of the application of the method of the invention. In the crossing scheme shown, the weft yarns 5*b*, 5*c* are interlaced alternately around the upper warp yarns 4*a*, 4*b* etc and the lower warp yarns 10*a*, 10*b* etc, whereas the weft yarns 5*a* extend linearly between the upper and lower warps 4*a*, 4*b* etc and 10*a*, 10*b* etc. As the views are derived by orthographic projection, the dimension 11 selected in the model for the spacing between the planes of the centrelines of the warp yarns has no affect upon the relevant areas calculated from the views.

Assuming all the large diameter warp yarns 4*a*, 4*b* etc, the small diameter warp yarns 10*a*, 10*b* and the weft yarns 5*a*, 5*b* are made from three respective materials with respective moisture management properties (hydrophilicity, hydrophobicity) then the unit cell 3 has a rectangular border of dimension $S_1 \times S_2$, more specifically the unit cell 3 is bounded by the longitudinal centre lines of the warp yarns 4*a*, 10*a* and the weft yarns 5*a*, 5*b*.

FIGS. 14*b* and 14*c* show views of the first side 8 and second side 9 of the unit cell 3 projected onto respective planes parallel to the plane of the fabric 7. As there is no opening visible between the yarns the total projected area ($A_{tot}$) of the yarns is calculated from the following formula:

$$A_{tot}=S_1S_2$$

If the warp yarns 10*a*, 10*b*, 10*c* etc are hydrophilic relative to at least one of the other yarns 4*a*, 4*b*, 5*a*, 5*b* etc, the total projected area of hydrophilic yarn on the first side ($A_{1phi}$) is determined from FIG. 14*b* and the projected area of the unit cell 3 for the warp yarn 10*a* alone. It is determined from the geometry, and it will be clear that it is calculated from the following formula:

$$A_{1phi} = \left(S_2 - \frac{d_1}{2}\right)\left(S_1 - \frac{d_2}{2}\right)$$

If the warp yarns 4*a*, 4*b* are hydrophobic relative to the warp yarns 10*a*, 10*b*, 10*c* the total projected area of hydrophobic yarn on the second side ($A_{2pho}$) is calculated from FIG. 14*c* and the projected area of the unit cell 3 for the warp yarn 4*b* alone.

As described above, if $A_{1phi}$ exceeds 50% of $A_{tot}$ and $A_{2pho}$ is between 40% and 70% of $A_{tot}$, then a fabric according to the fabric design represented by the model is manufactured.

Likewise the total projected area of hydrophilic yarn on the second side ($A_{2phi}$) may be determined from FIG. 14*c* and the total projected area of hydrophobic yarn on the first side ($A_{1pho}$) may be calculated from FIG. 14*b*. If $A_{1pho}$ is between 40% and 70% of $A_{tot}$, and $A_{2phi}$ exceeds 50% of $A_{tot}$, then a fabric according to the fabric design represented by the model is manufactured. Otherwise at least one of the properties defining the model (the quantities of hydrophilic and hydrophobic yarns, yarn crossing scheme, yarn cross section for each yarn and yarn spacing) is varied and the calculations performed until a result having a pair of opposing sides within these two ranges is obtained. While these examples and the FIG. 15 refer to conventional clothing fabrics this technology also has application to fabrics manufactured in the nano-scale for medical applications, and the like.

Embodiments of the invention have been described, however it is understood that variations, improvements or modifications can take place without departure from the spirit of the invention or scope of the appended claims.

What is claim is:

1. A technique for producing a woven moisture management fabrics including hydrophilic and hydrophobic yarns, comprising:

a. selecting a fabric design comprising hydrophilic and hydrophobic yarns, a yarn crossing scheme, yarn cross section for each yarn, and yarn spacing in warp and weft directions;

b. creating a model of the yarns of the fabric design;

c. identifying a plane of the fabric in which warp and weft yarns generally lie;

d. identifying a repeating unit cell of the model or a discrete multiple of unit cells; of the model;

e. identifying, from orthographic projection onto respective planes substantially parallel to the plane of the fabric, of a first side and an opposing second view of a second side, of the unit cell or the discrete multiple of unit cells;

f. calculating and summing projected areas of each yarn in one of the first and second views to determine a total projected area of the yarns in the respective first and second views;

g. calculating and summing projected areas of each hydrophilic yarn in each of the first and second views, respectively, to determine a projected area of the hydrophilic yarn for each of the first and second views;

h. calculating and summing projected areas of each hydrophobic yarn in each of the first and second views, respectively, to determine a projected area of the hydrophobic yarn for each of the first and second views;

i. determining whether the projected area of hydrophobic yarn on one of the first and second views is between 40% and 70% of the projected area, and whether the projected area of hydrophilic yarn for the other of the first and second views exceeds 50% of the total projected area, j. if the projected area of hydrophobic yarn for one of the first and second views is not between 40% and 70% of the total projected area, or the projected area of hydrophilic yarn for the other of the first and second views does not exceed 50% of the total projected area, changing the fabric design by varying at least one of quantities of hydrophilic and hydrophobic yarns, yarn crossing scheme, yarn cross section for each yarn, and yarn spacing, and repeating steps b to i until the projected area of hydrophobic yarn for one of the first and second views is between 40% and 70% of the total projected area, and the projected area of hydrophilic yarn for the other of the first and second views exceeds 50% of the total projected area; and k. manufacturing a fabric according to the fabric design having the projected area of hydrophobic yarn for one of the first and second views between 40% and 70% of total projected area, and the projected area of hydrophilic yarn for the other of the first and second views exceeding 50% of the total projected area.

2. A technique for producing a woven moisture management fabric including hydrophilic and hydrophobic yarns, comprising:

a. selecting a fabric design comprising hydrophilic and hydrophobic yarns a, yarn crossing scheme, yarn cross section for each yarn, spacing in warp and weft directions;

b. summing areas or structure cross points of each hydrophilic yarn on each of first and second sides of the fabric to determine a hydrophilic area;

c. summing or structure cross points of each hydrophobic yarn on each of first and second sides of the fabric to determine a hydrophobic area;

d. determining whether the hydrophobic area on one of the first and second sides is between 40% and 70% of total area of the respective one of the first and second side, and whether the hydrophilic area on the other of the first and second sides exceeds 50% of the total area, of the respective one of the first and second sides;

e. if the hydrophobic area on one of the first and second sides is not between 40% and 70% of the total area of the respective one of the first and second sides, or the hydrophilic area on the other of the first and second sides does not exceeds 50% of the total area of the respective on of the first and second sides, changing the fabric design by varying at least one of quantities of hydrophilic and hydrophobic yarns, yarn crossing scheme, yarn cross section for each yarn, and yarn spacing, and repeating steps b to d, until the hydrophobic area on one of the first and second sided is between 40and 70% of the total area of the respective one of the first and second sides and the hydrophilic area on the other of the first and second sides of the respective one of the first and second sides exceeds 50% of the total area; and f. manufacturing a fabric according to the fabric design having the hydrophobic area on one lf the first and second sides between 40% and 70% of the total area of the respective one of the first and second sides, and the hydrophilic area on the other of the first and second sides exceeding 50% of the area of the respective one of the first and second sides.

* * * * *